US006095288A

United States Patent [19]

Rivera et al.

[11] Patent Number: 6,095,288

[45] Date of Patent: Aug. 1, 2000

[54] PIT-LESS ELEVATOR

[75] Inventors: James A. Rivera; Bruce St. Pierre, both of Bristol; Frank M. Sansevero, Glastonbury, all of Conn.

[73] Assignee: Otis Elevator Company, Farmington, Conn.

[21] Appl. No.: 09/296,885

[22] Filed: Apr. 22, 1999

[51] Int. Cl.[7] ..... B66B 5/28

[52] U.S. Cl. ..... 187/343

[58] Field of Search ..... 187/343, 344, 187/345, 294, 414

[56] References Cited

U.S. PATENT DOCUMENTS

| | | | |
|---|---|---|---|
| 3,739,881 | 6/1973 | Cilderman et al. | 187/254 |
| 3,768,596 | 10/1973 | Solymos | 187/343 |
| 5,195,616 | 3/1993 | Yoo et al. | 187/344 |

FOREIGN PATENT DOCUMENTS

| | | | |
|---|---|---|---|
| 4-75987 | 12/1982 | Japan | 187/344 |
| 987171 | 12/1982 | U.S.S.R. | 187/344 |

*Primary Examiner*—Robert P. Olszewski
*Assistant Examiner*—Thuy V. Tran

[57] ABSTRACT

A pitless elevator system removes a car buffer and machine, and other components where so equipped from under the elevator car such that the elevator car can be operated to a clearance between it and a floor of a hoistway of about three inches. The machine may be mounted on board the car or may be located elsewhere and the car buffer located in normal side clearance space. The system further provides a retractable toe guard to allow the car to bottom at the indicated distance from the floor. The system facilitates retrofit applications of elevators without the prior art drawback of digging a pit.

14 Claims, 3 Drawing Sheets

PIT-LESS ELEVATOR

BACKGROUND OF THE INVENTION

1. Field of the Invention

The invention relates to the elevator art. More particularly, the invention relates to an elevator system which is particularly conducive to retrofitability in structures without elevator pits as well as new construction where a pit is not desired or permitted.

2. Prior Art

In the elevator art it has been conventional for a very long period of time to build an elevator hoistway, i.e. the shaft in which an elevator car is moved upwardly and downwardly, with a pit. A pit is a continuation of the hoistway downwardly below the intended lowest level at which the elevator car will have duty. The lowest level may be a first floor or a basement, etc. Typically, a pit is about 4–5 feet in depth below the lowest elevator car level and thus requires a substantial amount of excavation of material at not insignificant cost. Moreover, the deeper a pit is dug the more likely it becomes that the water table in the area will be reached which further complicates matters. Where an elevator system is a retrofit in an existing structure, the excavating of a pit is complicated further and further increases expense. Additionally, the pit takes up space that could be otherwise employed. The latter interpretation occurs where an elevator stops a level above a basement and the pit is located in the basement. Digging is thus not specifically required for the pit itself but a portion of the basement is lost and the elevator car, in a conventional system, could not be lowered to the basement level.

A pit is conventionally required for elevator systems in order to house the over limit car buffer and pit sheaves, and to provide clearance for the elevator car entrance toe guard which can be up to two meters in length and is rigid. The toe guard therefore requires in such a case at least two meters of clearance and preferably more to avoid bumping the bottom of the shaft when the elevator is at its lowest point. This could occur if insufficient space were left in the pit to receive the toe guard in the event the car continued too far downwardly in the hoistway (an over limit condition).

The foregoing limitations have been consistent drawbacks of the elevator art. In an era of ever increasing cost of space and construction, the art is in need of pitless elevator systems for both new construction and retrofit applications in existing structures.

SUMMARY OF THE INVENTION

The above-identified drawbacks of the prior art are overcome or alleviated by the pitless elevator system of the invention.

The invention simplifies new construction by eliminating the conventional need for a pit and facilitates the retrofitting of existing structures with elevators by obviating the need for the pit.

In order to avoid a pit, the elements traditionally housed therein must be relocated and otherwise modified to facilitate elevator system operation without the undercar clearance of the pit. The pitless elevator system of the invention includes one or more car buffers located in a portion of the side clearance space necessary in all elevator systems. The car buffers will in the event of over limit conditions of the car, contact strike angle(s) on the car to brake its movement. Since the car buffers are not located under the car, clearance therefor is not needed. Moreover, pit sheaves, if employed for the elevator roping configuration, are preferably nestled near or between the structural beam rails, and the machine is not placed underneath the car but is located elsewhere within the hoistway. Locations include on the car, in the tower of the hoistway, between the rails or on side clearance space. The location of the machine is not critical so long as it is not located under the car.

Another aspect of the system of the invention is a toe guard which requires virtually no clearance and is automatically or manually retractable under the bottom surface of the elevator car. The combination of features in the elevator system of the invention allows for pitless installation and greatly benefits the art.

BRIEF DESCRIPTION OF THE FIGURES

Referring now to the drawings wherein like elements are numbered alike in the several FIGURES.

DETAILED DESCRIPTION OF THE INVENTION

Figure 1:
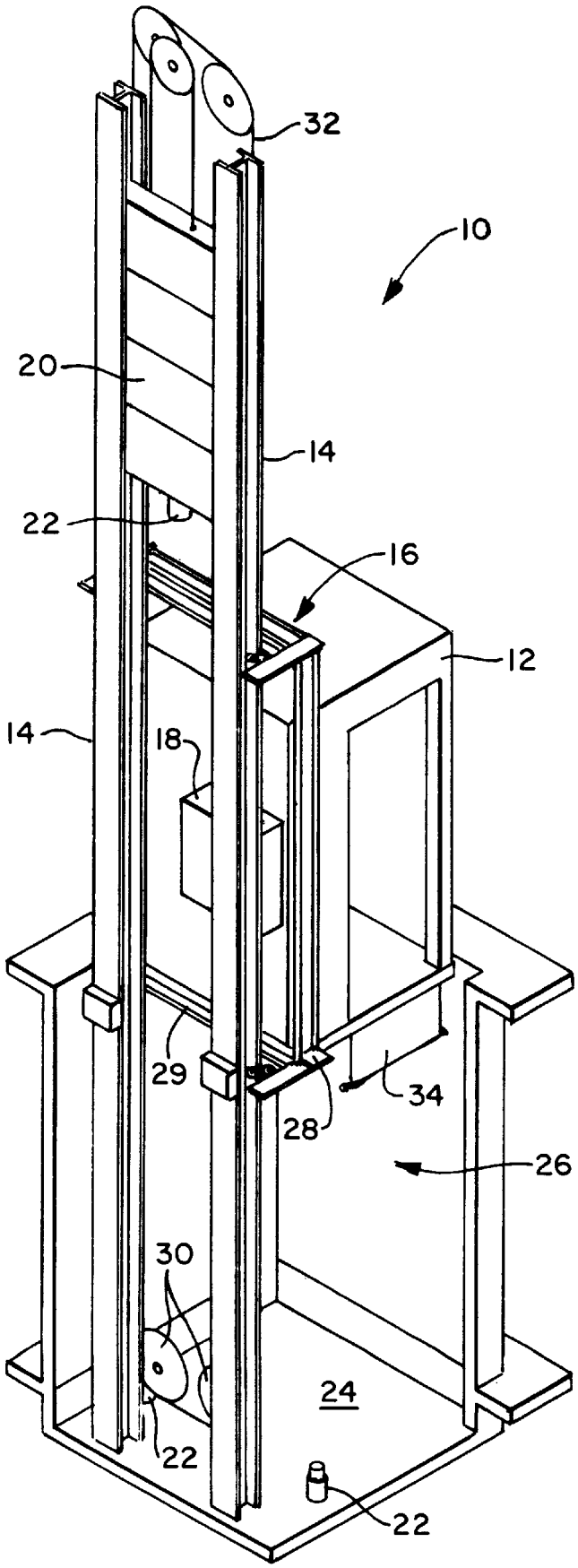
FIG. 1 is a perspective view of the pitless elevator system of the invention with the elevator car illustrated at a second level to depict clearly one location of the car buffer and the clear floor of the hoistway.
Figure 2:
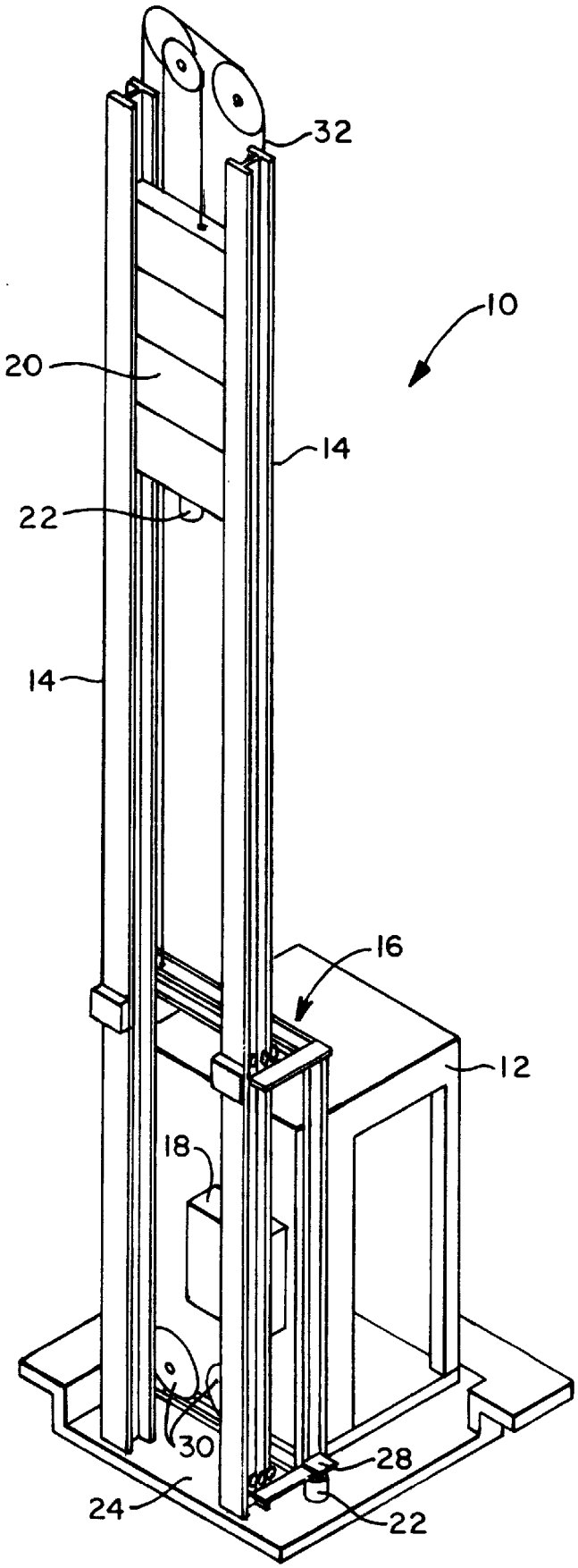
FIG. 2 is another perspective view of the invention with the car at the first level.

An elevator system 10 contains certain basic elements that are represented in the invention and illustrated in FIGS. 1 and 2. These elements include an elevator car 12 guided by at least one and preferably two guide rails 14 through the intermediary frame 16. The system 10 further includes a machine 18, shown as an on-board machine in the illustration but not limited as such, and several sheaves (discussed hereunder). A counterweight is illustrated as 20 and car buffers 22 are located on the floor 24 of the hoistway 26 in which car 12 is cycled, the buffers being placed outside of the area directly under the car 12 (also defined for purposes of this application as the elevator car footprint).

In order to achieve the desired beneficial result of the invention and provide a functioning elevator system without a pit, all of the conventional residents of the pit must be relocated to clearance spaces around the portion of hoistway 26 occupied by car 12. In a preferred embodiment the arrangement is as illustrated in FIGS. 1 and 2 wherein it will be appreciated that car buffers 22 are located in the foreground of the drawing and background of the drawing almost hidden behind the background rail 14 correspond to side clearance space for the elevator system. It will also be appreciated that the pit sheaves used in the particular roping configuration shown are located in such clearance space. It is noted that pit sheaves are not a necessary part of the invention, but if used must be located outside of the elevator car footprint. Considering car buffers 22, it is axiomatic that since they are not located underneath the car 12 as would conventionally be the case (in the conventional case only one would be used), it must have provision for a surface that will contact the car buffer in the event of an overlimit condition. For this purpose a strike angle 28 is provided in a secured relationship to frame 16.

Strike angle 28 is preferably constructed of a material and configuration to become a structural member and support the full load of the elevator car 12 in the event of an overlimit condition resulting in contact between strike angle 28 and car buffer 22. In one preferred embodiment, the strike angle 28 is constructed of ½ inch thick steel which is fastened in a structural manner to frame 16. Frame 16 further provides, as is common, the connection to cables for lifting the elevator car. In one preferred embodiment of the invention, car buffer 22 stands approximately 18 inches tall. In such an embodiment the strike angle 28 will be configured to stop at about 21 inches above the floor 24 of hoistway 26. Thus, a 3 inch space buffer will exist between the strike angle 28 and car buffer 22. This is beneficial since in the event a very small overrun occurs, the strike angle 28 will not come in contact with buffer 22. In this condition, where strike angle 28 is about 21 inches above floor 24, a base 30 of elevator car 12 will preferably hover about 3 inches above floor 24.

Another possible resident of the pit is pit sheaves 30. Pit sheaves may or may not be employed in elevator systems as dictated by roping configurations. Where pit sheave(s) are used they must not be located under the elevator car in accordance with this invention. In the drawing figures appended hereto, one of the pit sheaves 30 is filly visible and the other is nearly filly obscured by foreground rail 14. Pit sheaves 30 have been relocated in the system of the invention to a clearance area between car 12 and rails 14. In this position the elevator rope 32 is easily alignable and the sheaves 30 do not limit the downward movement of the car 12.

Another component of a systems of a conventional variety that is addressed in the system of the invention is toe guard 34. Conventionally, as stated hereinbefore, the toe guard is rigid and long and therefore requires a large amount of vertical clearance located below the lowest level of car 12. In pit elevator systems such clearance is available in the pit, however in the pitless elevator system of the invention, there is no clearance space available into which the toe guard may extend when the car is at the lowest level.

Figure 3:
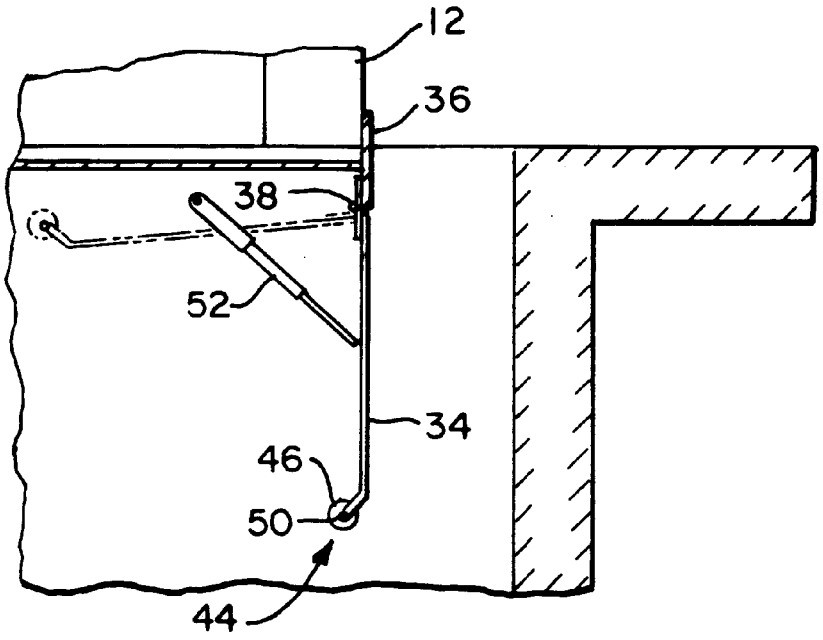
FIG. 3 is an elevation view of a portion of the elevator car having a toe guard in the deployed condition.
Figure 4:
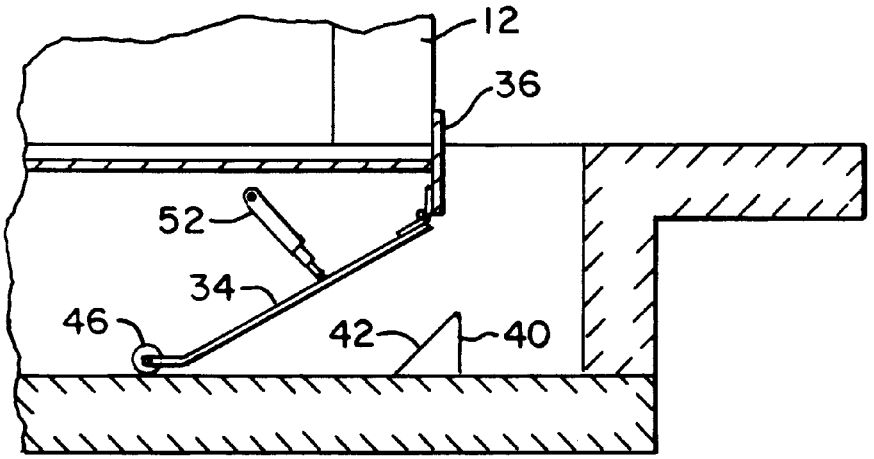
FIG. 4 is an elevation view of the toe guard of the invention in the partially retracted position.

Referring to FIGS. 3 and 4, a retractable toe guard 34 of the elevator system of the invention is illustrated in the deployed position and partially retracted position respectively (the fully retracted position is shown in phantom lines in FIG. 4). The retractability of the guard 34 allows the full function of a toe guard while obviating the need for substantial vertical clearance space.

Guard 34 is hingedly connected to car 12 at a suitable member 36 through preferably a spring hinge 38 although it will be appreciated that any type of hinge arrangement may be substituted if desired such as a living hinge, plates and pin hinges, etc. Where a spring hinge 38 is employed, toe guard 34 will automatically assume the deployed position of FIG. 3 in the absence of an impetus to urge toe guard 34 into the retracted position (illustrated as partially retracted in FIG. 4). One contemplated form of impetus is kick member 40 which provides an angular surface 42 aligned with the toe guard 34 in the deployed position (FIG. 3). Upon toe guard 34 contacting surface 42 it is urged toward the retracted position. Once the toe guard 34 has begun moving to the retracted position the continued downward movement of the elevator car 12 will continue to cause the toe guard 34 to collapse into the retracted position. Surface 42 is preferably about 45° inclined relative to a plane in which toe guard 34 resides when in the filly deployed position. In order to assist the desired movement of toe guard 34, a distal end 44 thereof comprises a roller 46 preferably on each end of guard 34. Roller 46 is mounted to offset 48 in guard 34 to increase angular movement of guard 34 when in contact with kick member 40. Roller 46 is connected of offset 48 via pin 50. Roller 46 also reduces noise associated with moving guard 34 into the retracted position. It will be appreciated that although slightly more noise may be developed by toe guard 34 without roller 46 during retracting (guard 34 will scrape on floor 24) the device will still function as desired.

The retractable toe guard 34 thus enables the pitless elevator system of the invention and additionally facilitates inspection of the elevator car and hoistway without lifting the car as high as would otherwise been necessary with a rigid toe guard. The function of inspection is augmented by an arm 50 which may be manual or powered to retract toe guard 34 or to deploy toe guard 34 (in applications where the toe guard spring hinge does not automatically deploy toe guard 34).

The elevator system of the invention combines the benefits of the individual features of the car buffer position, the pit sheave position and the retractable toe guard to render pitless operation possible and reliable and thereby reduces the cost of new construction elevator systems and enables retrofit systems.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A pitless elevator system comprising:

a hoistway having a floor;

a rail system disposed in said hoistway;

a car buffer; and an elevator car mounted to said rail system and reciprocally moveable thereon, said car including a structural member positioned to engage said buffer, said car defining a footprint on said floor, wherein said buffer is located outside said footprint and said footprint being free from obstruction.

2. A pitless elevator system as claimed in claim 1 wherein said elevator system further includes a pit sheave located without said footprint.

3. An elevator system comprising:

a hoistway;

a rail system disposed in said hoistway;

a car buffer; and an elevator car hoistably attached to said rail system, said elevator car being moveable between a first level and an $n^{th}$ level, said first level being at a floor of said hoistway, said car including a structural member positioned to engaged said car buffer;

wherein said car buffer is located in clearance space of said hoistway adjacent an area in which said elevator car moves.

4. An elevator system as claimed in claim 3 wherein said structural member includes a strike angle aligned with said car buffer.

5. An elevator system as claimed in claim 3 wherein said elevator system includes pit sheaves located in clearance space of said hoistway adjacent an area in which said elevator car moves.

6. An elevator system as claimed in claim 3 wherein said elevator system further comprises a retractable toe guard.

7. An elevator system as claimed in claim 6 wherein said toe guard further includes an actuator for at least one of deployment and retraction and which actuator is at least one of automatic and manually operable.

8. An elevator system as claimed in claim 6 wherein said toe guard is spring hingedly mounted to said elevator car.

9. An elevator system as claimed in claim 6 wherein said toe guard is hingedly mounted to said elevator car.

10. An elevator system as claimed in claim 9 wherein said toe guard further includes a roller at an edge distal from an edge whereat said toe guard is hingedly mounted to said elevator car.

11. An elevator system as claimed in claim 9 wherein said toe guard further includes a bent section adjacent an edge of said toe guard distal from an edge of said toe guard whereat said toe guard is hinged by mounted to said elevator car.

12. An elevator system as claimed in claim 6 wherein said elevator system further includes a kick member mounted to said floor and aligned with said toe guard.

13. An elevator system comprising:

a hoistway having a floor;

a car buffer; and an elevator car moveable within said hoistway, said car including a structural member positioned to engage said buffer, said car defining a footprint on said floor, wherein said buffer is located outside said footprint and said footprint being free from obstruction.

14. An elevator system as claimed in claim 13 wherein said elevator system further includes a pit sheave located without said footprint.

* * * * *